US006868916B2

(12) United States Patent
Petersen

(10) Patent No.: US 6,868,916 B2
(45) Date of Patent: Mar. 22, 2005

(54) FIRE SPRINKLER SYSTEMS

(75) Inventor: Francis Petersen, Prescott, WI (US)

(73) Assignee: Phillips Plastics Corporation, Phillips, WI (US)

( * ) Notice: Subject to any disclaimer, the term of this patent is extended or adjusted under 35 U.S.C. 154(b) by 250 days.

(21) Appl. No.: 10/104,055

(22) Filed: Mar. 25, 2002

(65) Prior Publication Data

US 2002/0134557 A1 Sep. 26, 2002

Related U.S. Application Data

(60) Provisional application No. 60/278,444, filed on Mar. 26, 2001.

(51) Int. Cl.[7] ..... A62C 37/08; A62C 37/00; A62C 37/12

(52) U.S. Cl. ..... 169/37; 169/56; 169/57

(58) Field of Search ..... 169/37, 56, 57, 169/58, 59, 16; 239/DIG. 4

(56) References Cited

U.S. PATENT DOCUMENTS

| | | | | | |
|---|---|---|---|---|---|
| 3,613,995 | A | | 10/1971 | Kane | |
| 3,896,880 | A | | 7/1975 | Asp | |
| 4,139,062 | A | * | 2/1979 | Rago | 169/37 |
| 4,298,068 | A | * | 11/1981 | Bray | 169/39 |
| 4,437,611 | A | * | 3/1984 | Gilroy | 239/453 |
| 4,465,141 | A | * | 8/1984 | Johnson | 169/37 |
| 4,625,915 | A | | 12/1986 | Cockman | |
| 4,739,934 | A | | 4/1988 | Gewelber | |
| 4,905,766 | A | | 3/1990 | Dietz et al. | |
| 4,938,292 | A | * | 7/1990 | Johnson | 169/19 |
| 5,072,792 | A | | 12/1991 | Simons et al. | |
| 5,080,176 | A | | 1/1992 | Polan et al. | |
| 5,109,929 | A | | 5/1992 | Spears | |
| 5,152,458 | A | * | 10/1992 | Curtis | 239/222.17 |
| 5,392,993 | A | | 2/1995 | Fischer | |
| 5,425,921 | A | * | 6/1995 | Coakley et al. | 422/102 |
| 5,613,563 | A | | 3/1997 | Johnson | |
| 5,839,667 | A | | 11/1998 | Fishcer | |
| 5,924,492 | A | | 7/1999 | Kikuchi et al. | |
| 6,082,632 | A | | 7/2000 | Clark et al. | |
| 6,209,654 | B1 | | 4/2001 | Curless | |
| 6,347,669 | B1 | | 2/2002 | Sundholm | |

* cited by examiner

*Primary Examiner*—David A. Scherbel
*Assistant Examiner*—Darren Gorman
(74) *Attorney, Agent, or Firm*—Foley & Lardner LLP

(57) ABSTRACT

A fire sprinkler formed by an injection molding process is provided comprising a molded plastic body portion made of an injection molded plastic having a substantially hollow central portion for allowing water to pass therethrough, the hollow central portion extending from a distal end to a proximate end of the molded plastic body, a diffuser head portion located in the vicinity of the distal end of the hollow central portion, a sealing member made of an injection molded elastomeric material in proximity to the hollow central portion, and a link portion. When the link reaches a predetermined temperature the link portion is activated to start the flow of water out of the sprinkler.

6 Claims, 6 Drawing Sheets

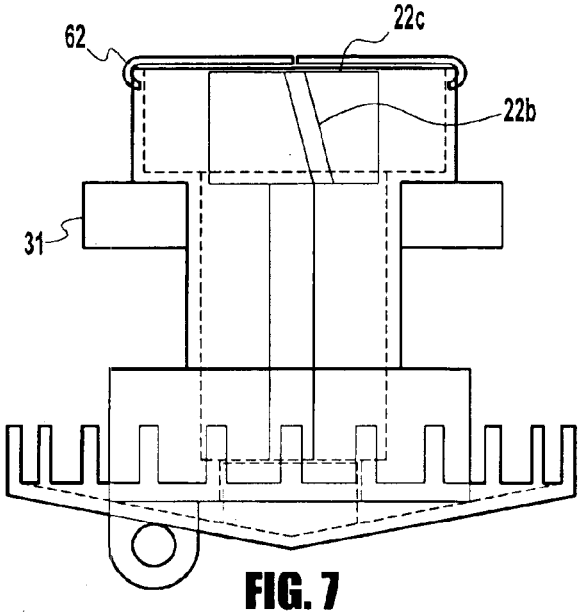
FIG. 7
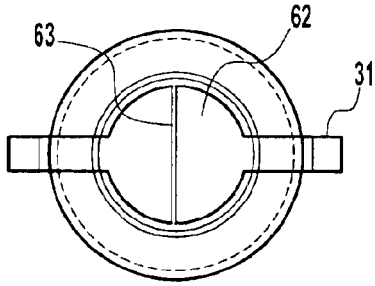
FIG. 8A
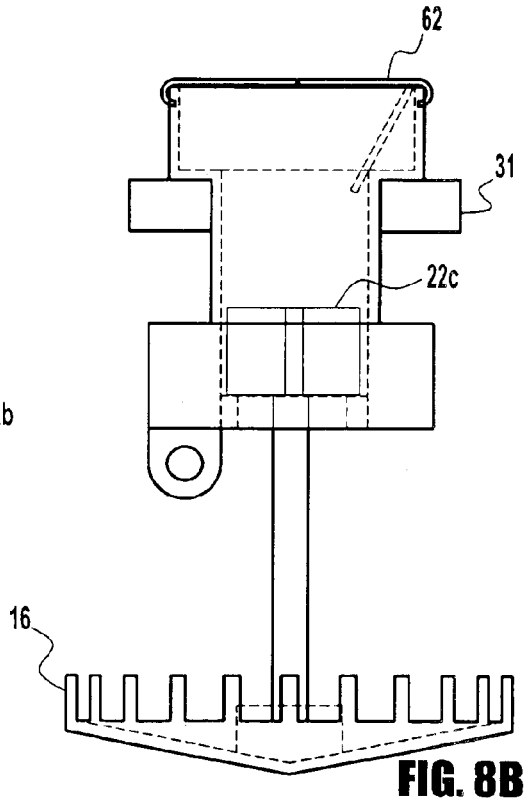
FIG. 8B
FIG. 11
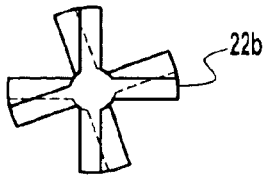

FIRE SPRINKLER SYSTEMS

CROSS-REFERENCE TO RELATED PATENT APPLICATIONS

This application claims priority to U.S. provisional application No. 60/278,444 filed Mar. 26, 2001, which is hereby incorporated by reference in its entirety.

BACKGROUND OF THE INVENTION

1. Field of the Invention

The present invention relates to sprinkler systems, preferably made from an injection molded plastic material.

2. Description of the Known Art

Sprinkler systems are known in the art. However, until recently, safety regulations have required them to be made of metal. That is, in the past, safety regulations for sprinkler systems required they be run in steel pipe, using metal sprinkler systems having metal trigger mechanisms. In addition, sprinkler systems had to be installed by licensed installers. These old safety regulations made installation very expensive and prohibitive for residential use in everything but the largest houses. With new safety regulations, however, sprinkler systems can now be run in plastic pipe.

SUMMARY OF THE INVENTION

One object of the invention is to overcome the disadvantages of the known art described above. Another object of the invention is to provide a cost-effective method of adding a sprinkler system to a residential, commercial or light commercial building. Yet another object of the invention is to provide an inexpensive, injection-molded plastic device, that can be made from a number of different plastics, with a number of ways to turn a sprinkler system on. Still another object of the invention is to provide a sprinkler that is simple and dependable. Yet another object of the invention is to provide a sprinkler that is aesthetically pleasing. Yet another object of the invention is to provide a sprinkler where components are easily replaceable.

In order to achieve the foregoing and further objects, there has been provided according to one aspect of the invention, a sprinkler, preferably formed by an injection molding process, that includes a molded plastic body portion made of an injection molded plastic having a substantially hollow central portion for allowing water to pass therethrough, the hollow portion extending from a distal end to a proximate end of the molded plastic body; a diffuser head portion preferably located in the vicinity of the distal end of the hollow central portion; a sealing portion made of an injection molded elastomeric material in proximity to the hollow central portion; and a link port ion. When the link reaches a predetermined temperature the link portion is activated to start the flow of water out of the sprinkler.

In one preferred embodiment, the diffuser head portion is rotatable. In another preferred embodiment, the sealing portion is located in the vicinity of the proximate end of the hollow central portion. The sealing portion can be mounted on an insert that can be inserted into the sprinkler system with threads or with tabs. Preferably, the insert and the sealing portion are formed in a multi-shot injection molding process.

According to another aspect of the invention, there has been provided a sprinkler system that includes a sprinkler as described above; at least one conduit adapted for transporting water from a water source to the sprinkler; and a connector for joining the hollow portion of the body portion with the at least one conduit.

According to another aspect of the invention, there has been provided a sprinkler formed by a two-shot injection molding process that includes a molded plastic body portion comprising an injection molded plastic having a substantially hollow central portion for allowing water to pass therethrough, the hollow portion extending from a distal end to a proximate end of the molded plastic body; a diffuser head portion comprising an injection molded plastic and located proximate to the distal end of the hollow central portion, wherein one or both of the molded plastic body or diffuser head portion is formed in a first shot in a multi-shot injection molding process; a sealing portion made of an injection molded elastomeric material in proximity to the hollow central portion, the sealing portion is formed in a second shot in a multi-shot injection molding process; and a link portion. When the link reaches a predetermined temperature the link portion is activated to start the flow of water out of the sprinkler.

According to yet another aspect of the invention, there has been provided a method for forming a sprinkler described above by a two-shot injection molding process that includes providing a first mold configured in the shape of a molded plastic body portion, or providing a first mold configured in the shape of a diffuser head portion; injection molding, as a first shot, a first plastic material into the first mold to form a body portion or a diffuser head portion; providing a second mold configured to provide, with the body portion or diffuser head portion, a void having a cross sectional area bounded by the body portion or diffuser head portion and the second mold surface; injection molding, as a second shot, a material into the void to form a sealing portion; and providing a link portion, wherein when the link reaches a predetermined temperature the link portion is activated to start the flow of water out of the sprinkler.

Further objects, features and advantages of the present invention, will become it, readily apparent from detailed consideration of the preferred embodiments which follow.

BRIEF DESCRIPTION OF THE DRAWINGS

FIG. 7 depicts a sprinkler according to another preferred embodiment of the invention.

FIG. 8 depicts a sprinkler according to another preferred embodiment of the invention.

FIG. 11 is a top view of the top of diffuser head portion according to a preferred embodiment of the present invention.

DETAILED DESCRIPTION OF THE PREFERRED EMBODIMENTS

Figure 1D:
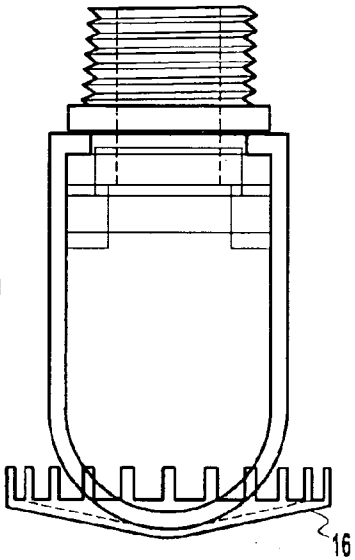
FIGS. 1*a*–1*e* depict a sprinkler according to a preferred embodiment of the invention.
Figure 1E:
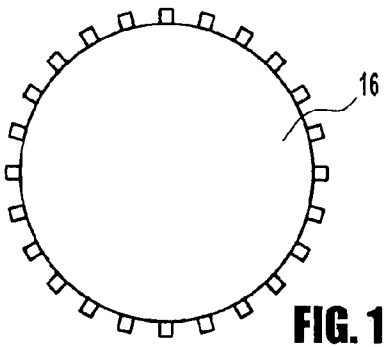
Figure 1C:
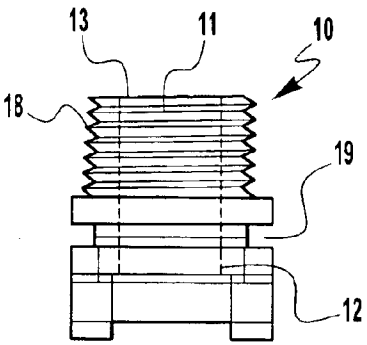
Figure 1A:
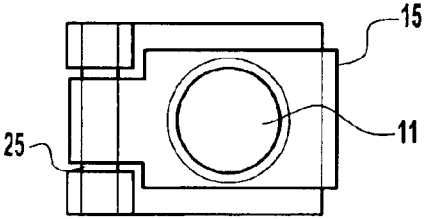
Figure 1B:
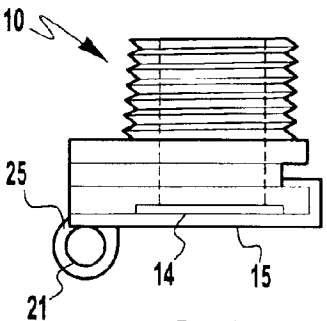

The present invention provides an inexpensive, preferably injection-molded plastic device, that can be made from a number of different plastics, with a number of ways to turn a sprinkler system on. The sprinkler head is made of a suitable plastic, preferably formed by an injection molding process. The sprinkler includes a molded plastic body portion 10 preferably made of an injection molded plastic having a substantially hollow central portion 11 for allowing water to pass therethrough. The hollow portion extends from a distal end 12 to a proximate end 13 of the molded plastic body portion 10. The body portion 10 can be made of any suitable plastic, preferably a heat resistant plastic, such as polyacetal, sold under the tradename, Delrin™, polysulphone, nylon and other well known heat resistant plastics. The body portion 10 preferably is made by an injection molding process, in particularly, a multi-shot injection molding process described more fully below.

The sprinkler also includes a diffuser head portion 16 located in the vicinity of, and preferably adjacent to, the distal end 12 of the hollow central portion 11. The diffuser head portion 16 functions as a water diffuser to spray water in a desired pattern. The materials of the diffuser head portion 16 can be the same or different as the body portion, and preferably are the same. The sprinkler also includes a sealing portion or member 14 that is made of an injection molded elastomeric material in proximity to the hollow central portion. The sealing portion 14 or member can be made of any material capable of forming a sealing fit between the body portion and diffuser head portion or between the body portion and the retainer portion 15 (FIG. 1).

Also included is a link portion 25. The link portion 25 is constructed such that when the link reaches a predetermined temperature, the link portion is activated to start the flow of water out of the sprinkler diffuser head. The link portion can be a lead-meltable link that would melt at about 165° F. The link portion may also be a "mousetrap-type" device that has a bimetal link, or a memory metal link, such as nitinol, that deflects at a given temperature, allowing the link portion to activate the sprinkler system. In another embodiment, the body portion 10 also may include an extension or projection shown as 21 in FIGS. 1 to 3, that acts to support the link 25.

According to one preferred embodiment, there is provided a retainer 15 (shown only in FIG. 1) that forms a water tight seal with the body portion along with the elastomeric material. This embodiment is described in more detail below.

Between the body portion 10 and the diffuser head portion 16 or retainer 15, a sealing member 17 is positioned. The sealing member provides a water-tight seal, when the sprinkler is not in use, to protect against leakage.

As stated above, a goal of this invention is to make the sprinkler as simple and dependable as possible. Along those lines, the applicant has found that a multishot injection molding process is especially suitable. Multi-shot processes, per se, are known in the art, and examples can be found in "Injection Molding Alternatives: A Guide for Designers and Product Engineers," Section 5.5: "Multicomponent Molding" by Jack Avery (Hanser Gardner Publishers, 1998, pages 113–117); "Process Selection For Multi-Shot Molding" by Mike Tolinski (Molding Systems, volume 56 number 1, January 1998, p 30–35); "Multi-Shot Values" by P. Coates, (Plastics and Rubber Weekly, No.1789, $4^{th}$ June 1999, p.7); "Case Study for Multi-Shot" by J. Hahn, (Antec *99 Conference Proceedings, New York City, $2^{nd}$–$6^{th}$ May 1999 p.406; and "Multi-Shot Injection Moulding" by J. Tinson, (Med.Device Technol., No.3, April 1998, p.26–8), all of which are incorporated by reference their entireties.

In a typical multi-shot process, the object to be molded is made from more than one material. A first material is injected into a first mold to form a first molded object. The first molded object is then removed from the first mold, and inserted into a second mold, typically by rotating the movable portion of the mold from the first mold to the second mold, into which a second material to be molded is injected to form the final molded object. The final molded object is thus a combination, e.g., laminate, of the first and second materials. Additional analogous molding steps using third, fourth and additional materials can also be, employed. These steps preferably all occur within the same molding cycle.

If a multi-shot injection molding is used in the present invention, the body portion 10 and/or diffuser head portion 16 preferably is formed in a first mold. According to this embodiment, a suitable plastic is injected into the mold to form the body portion and/or diffuser head portion. The body portion and/or the diffuser head portion then is removed from the first mold and moved into position with the second mold. The second mold and the body portion and/or the diffuser head portion form a cavity in the shape of the sealing portion. The elastomer forming the sealing portion is then injection molded into the cavity to form the sealing portion.

Afterwards, the composite body and/or diffuser head portion and sealing portion are removed from the second mold. If the body portion or the diffuser head portion was formed separately, the composite can then be fitted with the body portion and/or diffuser head portion, either before or after installation. The link is then added to form the sprinkler.

The present invention will now be described with reference to the non-limiting embodiments described in FIGS. 1–11.

FIGS. 1*a–e* show a molded hard plastic body portion with a hole through the center of threaded area 18. The hole (i.e., hollow central portion 11) through the center of the molded area, through which the water runs, will have at its bottom a sealing portion elastomer, preferably formed from a second-shot injection molding process, to seal the central portion 11 and to help insure against leakage. In this embodiment, the sealing member is a soft, pliable elastomer that does not hold the water pressure. It is thus supported up by retainer 15 that can be held in place with a fusible link 25, usually a metal link that melts at about 165 degrees F. The retainer 15 can be made out of metal or plastic, whichever is the most efficient and economical. The retainer can be made to stay attached or to fall free when the water pressure causes it to open.

The body portion preferably has a slot 19 in which to snap in the diffuser head portion 16 water diverter that hangs below the center of the threaded area. The diffuser head portion diverter will be arranged to cause the water to divert in a uniform manner to cover the area that the sprinkler is designed to sprinkle.

The sprinkler is activated when the fusible link 25 is activated, such as by melting. The retainer will be dropped, or forced, out of position by the water pressure, causing the sealing member to deflect and then burst as the retainer drops away. The water then flows freely in the diverter and is spread (sprinkled) around the room.

The sprinkler may be a factory-molded part. The body portion would preferably be replaced with the sealing member in it after each activation. This would help assure a good seal and a uniform device for increased dependability. In a preferred embodiment, to replace the sealing member, the plastic body portion 10 is unthreaded from the sprinkler system. A new plastic body portion with sealing member 14 is then threaded into the sprinkler system, the diffuser head 16 is replaced and the retainer portion with a link portion is put back into position.

Figure 2A:
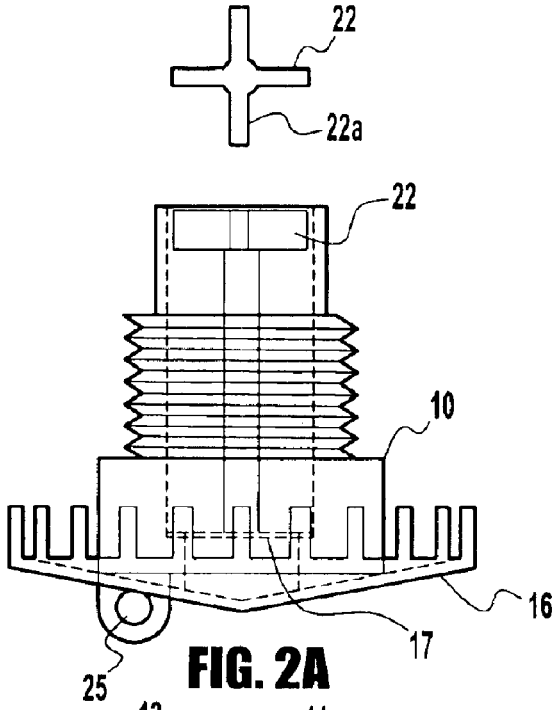
FIGS. 2*a* and 2*b* depict a sprinkler according to another preferred embodiment of the invention.
Figure 2B:
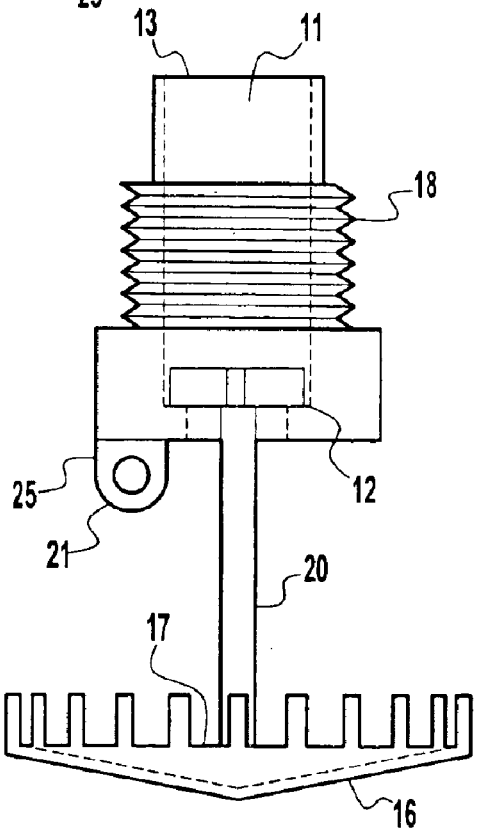

FIGS. 2*a–b* show another preferred embodiment. The sprinkler in FIG. 2 has a moveable diffuser head portion 16. In this embodiment, the sprinkler diffuser head portion 16 can be retracted back up into the body portion 10, and is held in place with a link portion, such as a fusible pin. As FIGS. 2*a–b* depict, a sealing member 17 is located between the diffuser head and the body portion to form a water tight sealing relationship. When the heat reaches the temperature to activate the link portion, such as by melting the fusible pin, the diffuser head 16 drops down a sufficient distance, preferably about two inches, releasing the seal, and turning the water on within the sprinkler. The sprinkler according to this embodiment may be reusable. To reset the sprinkler, one would push the diffuser head back into location and put in a link member, such as a new meltable, or fusible, pin, and it would be resealed.

As noted above, one object of the invention is to provide a more aesthetically pleasing sprinkler. This is accomplished by the embodiment shown in FIGS. 2*a–b* in that the sprinkler is substantially mounted flush with the ceiling and is thus significantly less obtrusive and noticeable.

In FIGS. 2*a–b*, the hard plastic threaded body portion may be a smooth, glued-together body. In this case, the threaded body has projection 21 with a hole in it for receiving a link portion, such as a meltable pin. The diffuser head portion in this embodiment has an extended shaft or portion 20 that has a stop 22 at the top, and a sealing member 17 in the form of an O-ring seal at the bottom. The stop includes radially extending members 22*a*. The O-ring sealing member is pushed up into the threaded body and then retained there by putting a pin through the threaded body under the diffuser.

The water pressure pushes down on the O-ring seal, which can be molded in a multi-shot injection molding as part of the diffuser head portion 16. The fusible portion that keeps the diffuser in place also holds the O-ring seal in place because it is all one body. When the fusible portion is activated, such as by melting, the water pressure will force the O-ring seal and the diffuser in a downward direction. This mechanism will fall until the stop hits the bottom of the threaded body retainer. At that point, full water pressure comes from the threaded body portion 10, and the stream will hit the diffuser head portion 16 and be diffused around the room in the area to be sprinkled. As noted above, in this embodiment, the threaded body portion 10 is substantially flush with surface of the ceiling, such that the diffuser head portion is held in place at the surface of the ceiling, thus making it aesthetically less noticeable obvious than a normal sprinkler system. However, when the link is released, it will drop down to the predetermined extended shaft length on the diffuser and operate as a normal suspended sprinkler system.

According to another embodiment of the application as shown in FIGS. 4, 7, 9 and 11 the diffuser head portion 16 has a stop 22 with radially extending members 22*b* that are angled and preferably elongated in the longitudinal direction. Upon activation, the diffuser head portion drops down as described above. When the flow of water strikes the angled members 22*b*, the diffuser head will rotate and assist in dispersing the water, particularly in the area close to the sprinkler. FIG. 11 shows a top view according to this embodiment.

Figure 3A:
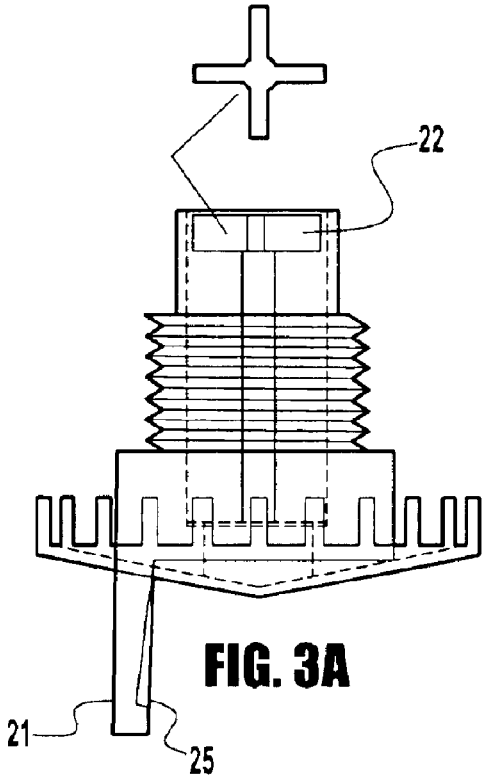
FIGS. 3*a* and, 3*b* depict a sprinkler according to another preferred embodiment of the invention.
Figure 3B:
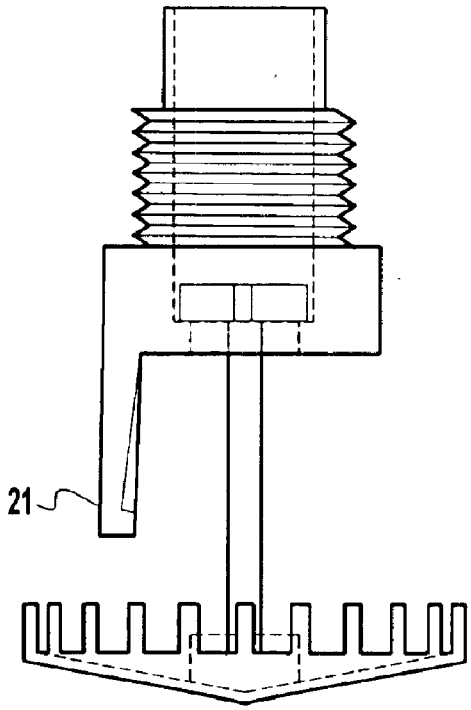

Another alternative embodiment is shown in FIGS. 3*a–b*. In FIGS. 3*a–b*, the link portion is a bimetal or nitinol trigger mechanism. It can be used in the embodiment shown in FIGS. 1, 2, 4, 7, 8 and described above and below. For example, if it is configured in a manner similar to FIG. 1 (not shown), it would be the second-shot molded sealing member and retainer portion as described with reference to FIG. 1. The link portion would be like a trigger mechanism having a short, post-like strip of either bimetal or nitinol, shown as 25 in FIGS. 3*a–b*. The trigger mechanism would pop out like a mousetrap and allow the retainer portion that is holding the sealing member in place to be released. The sealing member would then blow off, and the water would be distributed by the diffuser head portion that is snapped in underneath it.

Figure 4:
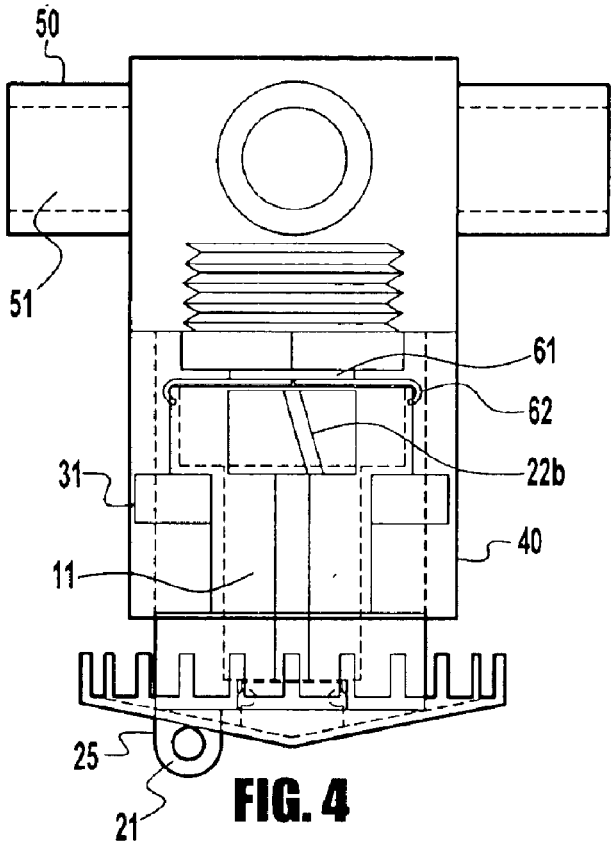
FIG. 4 depicts a sprinkler system according to another preferred embodiment of the invention.

If this embodiment is constructed in a manner that is similar to FIGS. 2*a–b* (as shown in FIGS. 3*a–b*) or e.g., FIG. 4, the threaded or tabbed body portion 10, includes a longer projecting member 21 that receives a bimetal, or memory metal, activating rod that is wedged between the diffuser head portion 16 and the end of the projection 21 of the threaded body portion 10. When a temperature reaches a predetermined set point, the bimetal, or memory strip, deflects, causing the bottom end to kick out, which will cause the diffuser head portion to drop due to gravity and water pressure and the water will begin to flow.

The diffuser head portion 16 can be made in various ways to cause the water flow to spread a desired amount depending on the room size and the sprinkler rating. It will also need to accommodate normal household water pressures that may be lower than a normal sprinkler water pressure.

Figure 5:
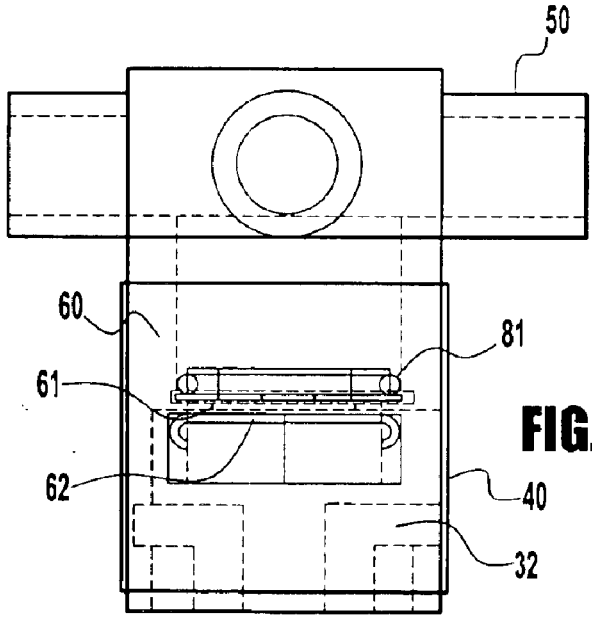
FIG. 5 depicts the body portion of the sprinkler according to another preferred embodiment of the invention.
Figure 6:
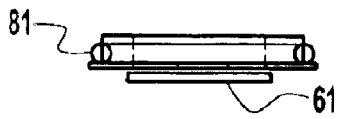
FIG. 6 is an isolated view of the sealing system to another preferred embodiment of the invention.

In another preferred embodiment shown in FIGS. 4, and 7–9, the body portion 10 is not required to be threaded into the sprinkler system. Instead, the body portion can include tabs 31 that can be inserted into slots in the sprinkler system 50 and rotated to lock the body portion into place in the sprinkler system 50. FIG. 5 shows ¼ turn lock slots 32 according to a preferred embodiment. FIG. 7 depicts the body portion 10 with tabs 31 before insertion into the sprinkler system.

Figure 9:
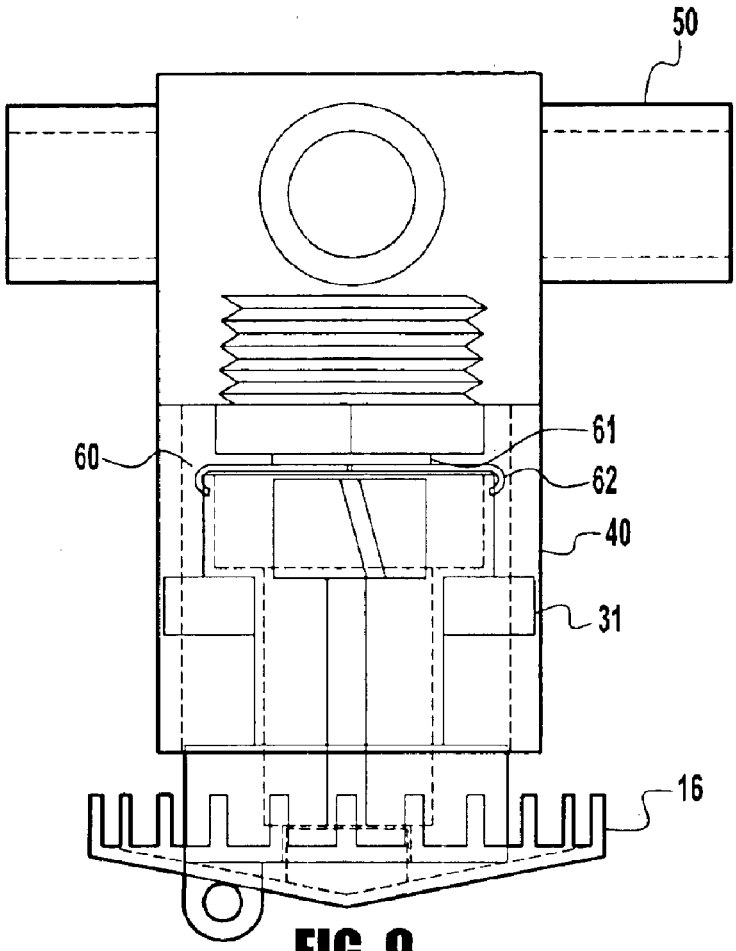
FIG. 9 depicts a sprinkler system according to another preferred embodiment of the invention.

The sprinkler system can include a support 40, preferably made of metal, that is connected to the rest of the sprinkler system 50 having hollow portions 51, as shown in FIGS. 4, 5 and 9. While the metal support is shown as having slots for receiving the tabs 31, the metal support can also have threads instead of slots for supporting body portions that are threaded such as those embodiments shown in FIGS. 1 to 3.

In embodiments where the body portion 10 is held by a locking tab and slot, it may be somewhat more difficult to nest the proximate portion 13 of the body portion 10 against the sprinkler system 50. In these "threadless" embodiments, it is preferable to have an additional sealing member 60 that is located at the interface of the proximate end 13 of the hollow central portion 11 of the body portion and the sprinkler system 50. This additional sealing provides a water-tight seal between the proximal end 13 of the body portion 10 and the sprinkler system 50. This additional sealing member is preferably replaceable. This can be in lieu of or in addition to the sealing member 14 or 17 located at the interface of the distal end 12 and the diffuser head portion 16 or retainer 15. FIG. 4 shows an embodiment with seal 17 and FIGS. 8–9 show embodiments with no sealing member between distal end 12 and diffuser head portion 16.

In a preferred embodiment, the additional sealing member 60 includes two components, a seal 61 and a support surface 62. The seal can be made of a thin elastomeric material, such as the material forming sealing portion 14 that can deflect and burst by the water pressure in the sprinkler system 50. To support the seal 61 before activation, a support surface 62 is provided, that is preferably coextensive with the area of the hollow central portion 11 of the body portion 10. See, e.g. FIG. 8*a*. In a preferred embodiment, the support surface 62 is a split cover as shown in FIGS. 4, 5, 8 and 9. In particular FIG. 8*a* shows a top view of the split cover 62 with score 63. FIG. 8*b* shows split cover in both the intact and a ghost view of one half of the split cover after activation.

Before activation, the support surface 62 is supported by the top 22*c* of stop 22 where it is held place by link portion 25. Upon activation, the stop 22*c* can no longer support the support surface. As a result, the water pressure in the sprinkler system ruptures the seal and the support surface allowing water to be dispersed by the diffuser head portion.

Figure 10A:
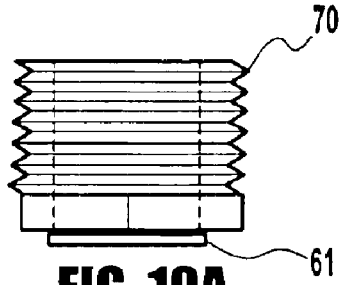
FIG. 10 depicts a replaceable seal according to a preferred embodiment of the invention.
Figure 10B:
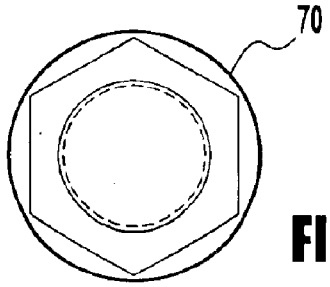

In one preferred embodiment, the seal can be mounted on a threaded insert 70 for ease of replacement as shown in FIG. 10. To reset the sprinkler head after activation, the body portion 10 is removed by aligning the tabs 31 with slots 32 to remove the body portion and diffuser head. The threaded insert 70 with seal 61 is then unscrewed and replaced with a new insert with an intact seal. A new supporting surface 62 is placed over the body portion and the body portion is inserted back into the slots of the sprinkler system and twisted into place.

In another embodiment, the seal 61 is mounted on a tabbed insert 80. In this embodiment, the insert 80 uses locking tabs 82 to hold the seal 61 in position before activation. An additional seal, such as an O-ring 81 is used to provide a water-tight seal between the insert 80 and the remainder of the sprinkler system 50. Thus, instead of screwing in the insert for replacement of the seal 61, the insert is simply pushed in and twisted into place.

In both of these embodiments, the insert and seals 61 and/or O-ring seal 81 can be made by a multi-shot process as described above.

While a number of preferred embodiments of the present invention have been described, it should be understood that various changes, adaptations and modifications may be made therein without departing from the spirit of the invention and the scope of the appended claims. As used herein and in the following claims, articles such as "the," "a" and "an" can connote the singular or plural.

What is claimed is:

1. A fire sprinkler formed by an injection molding process comprising:

a molded plastic body portion made of an injection molded plastic having a substantially hollow central portion for allowing water to pass therethrough, the hollow central portion extending from a distal end to a proximate end of the molded plastic body;

a diffuser head portion located in the vicinity of the distal end of the hollow central portion;

a sealing member made of an elastomeric material which is injection molded to at least one of the plastic body or the diffuser head in proximity to the hollow central portion; and a link portion, wherein when the link reaches a predetermined temperature the link portion is activated to start the flow of water out of the sprinkler;

wherein the sealing portion is in the shape of an O-ring and is located in between the distal end of the hollow central portion and the diffuser head portion.

2. A fire sprinkler according to claim 1, wherein the diffuser head portion further comprises an extended portion positioned in the hollow body portion, and wherein the extended portion includes a stop member at the end near the proximate end of the hollow body portion when the sprinkler is not activated.

3. A fire sprinkler according to claim 1, wherein the diffuser head portion is movable in a direction along the axis of the hollow central portion, and when said link is activated the diffuser head portion moves from the distal end in a direction away from the proximate end of the hollow portion.

4. A fire sprinkler according to claim 2, wherein the diffuser head portion is movable in a direction along the axis of the hollow central portion and when said link portion is activated the diffuser head portion moves from the distal end in a direction away from the proximate end of the hollow portion, until the stop member reaches the distal end of the hollow central portion.

5. A fire sprinkler according to claim 1, wherein the O-ring is molded in the diffuser head portion.

6. A method for forming fire sprinkler by a two-shot injection molding process, the fire sprinkler comprising:

a molded plastic body portion comprising an injection molded plastic having a substantially hollow central portion for allowing water to pass therethrough, said hollow portion extending from a distal end to a proximate end of the molded plastic body;

a diffuser head portion comprising an injection molded plastic and located proximate to the distal end of the hollow central portion, wherein one or both of the molded plastic body or diffuser head portion is formed in a first shot in a multi-shot injection molding process;

a sealing member made of an injection molded elastomeric material in proximity to the hollow central portion, the sealing member being formed in a second shot in a multi-shot injection molding process; and a link portion, wherein when the link reaches a predetermined temperature the link portion is activated to start the flow of water out of the sprinkler;

wherein the method includes providing a first mold configured in the shape of a molded plastic body portion, or providing a first mold configured in the shape of a diffuser head portion;

injection molding, as a first shot, a first plastic material into the first mold to form a body portion or a diffuser head portion;

providing a second mold configured to provide, within the body portion or diffuser head portion, a void having a cross sectional area bounded by the body portion or diffuser head portion and the second mold surface;

injection molding, as a second shot, a material into the void to form a sealing member; and providing a link portion, wherein when the link reaches a predetermined temperature the link portion is activated to start the flow of water out of the sprinkler.

* * * * *